US009702679B2

(12) United States Patent
Smith et al.

(10) Patent No.: US 9,702,679 B2
(45) Date of Patent: Jul. 11, 2017

(54) FRANGIBLE PROJECTILE

(71) Applicants: Greg A. Smith, St. Louis, MO (US); Victor D. Levin, Edwardsville, IL (US)

(72) Inventors: Greg A. Smith, St. Louis, MO (US); Victor D. Levin, Edwardsville, IL (US)

(73) Assignee: OLIN CORPORATION, St. Louis, MO (US)

( * ) Notice: Subject to any disclaimer, the term of this patent is extended or adjusted under 35 U.S.C. 154(b) by 357 days.

(21) Appl. No.: 13/953,170

(22) Filed: Jul. 29, 2013

(65) Prior Publication Data

US 2014/0326155 A1 Nov. 6, 2014

Related U.S. Application Data

(60) Provisional application No. 61/676,434, filed on Jul. 27, 2012.

(51) Int. Cl.
*F42B 12/74* (2006.01)
*F42B 12/34* (2006.01)
*F42B 12/02* (2006.01)

(52) U.S. Cl.
CPC ..... *F42B 12/74* (2013.01); *F42B 12/02* (2013.01)

(58) Field of Classification Search
CPC ..... F42B 12/74
USPC ..... 102/517
See application file for complete search history.

(56) References Cited

U.S. PATENT DOCUMENTS

| | | | | |
|---|---|---|---|---|
| 5,399,187 | A | 3/1995 | Mravic et al. | |
| 5,616,642 | A | 4/1997 | West et al. | 524/439 |
| 5,665,808 | A | 9/1997 | Bilsbury et al. | 524/439 |
| 5,679,920 | A | 10/1997 | Hallis et al. | 102/506 |
| 5,763,819 | A | 6/1998 | Huffman | 102/510 |
| 5,852,255 | A | 12/1998 | Hallis et al. | 102/439 |
| 5,852,858 | A | 12/1998 | Hallis et al. | 29/1.22 |
| 5,894,645 | A | 4/1999 | Hallis et al. | 29/1.23 |
| 5,917,143 | A | 6/1999 | Stone | 102/506 |
| 6,074,454 | A | 6/2000 | Abrams et al. | 75/247 |
| 6,090,178 | A | 7/2000 | Benini | 75/245 |
| 6,115,894 | A | 9/2000 | Huffman et al. | 29/1.22 |
| 6,174,494 | B1 * | 1/2001 | Lowden | B22F 1/0003 102/517 |
| 6,240,850 | B1 | 6/2001 | Holler | 102/439 |
| 6,257,149 | B1 | 7/2001 | Cesaroni | 102/515 |
| 6,263,798 | B1 | 7/2001 | Benini | 102/430 |
| 6,536,352 | B1 | 3/2003 | Nadkarni et al. | 102/506 |
| 6,691,623 | B1 | 2/2004 | Stone | 102/506 |
| 6,694,888 | B2 | 2/2004 | Jopson et al. | 102/506 |
| 6,799,518 | B1 | 10/2004 | Williams | 102/513 |
| 6,892,647 | B1 | 5/2005 | Stone | 102/506 |

(Continued)

FOREIGN PATENT DOCUMENTS

| | | | |
|---|---|---|---|
| EP | 0626557 | 11/1994 | |
| GB | EP 0626557 A1 * | 11/1994 | F42B 12/74 |

OTHER PUBLICATIONS

International Search Report and Written Opinion for PCT/US2013/052509 Date: May 15, 2014 pp. 12.

(Continued)

*Primary Examiner* — Reginald Tillman, Jr.

(74) *Attorney, Agent, or Firm* — Harness, Dickey & Pierce, P.L.C.

(57) ABSTRACT

A frangible projectile includes a sintered mass of a plurality of copper or copper alloy plated iron or iron alloy core particles.

11 Claims, 2 Drawing Sheets

(56) References Cited

U.S. PATENT DOCUMENTS

| | | | | |
|---|---|---|---|---|
| 7,143,679 | B2 | 12/2006 | Yaich | 86/54 |
| 7,322,297 | B2 | 1/2008 | Yaich | 102/517 |
| 7,380,503 | B2 | 6/2008 | Williams et al. | 102/518 |
| 7,555,987 | B2 | 7/2009 | Powers, Jr. | 102/506 |
| 7,685,942 | B1 | 3/2010 | Powers, Jr. | 102/506 |
| 2009/0301338 | A1* | 12/2009 | Schmitz et al. | 102/448 |
| 2010/0071579 | A1 | 3/2010 | Powers, Jr. | |
| 2010/0083861 | A1 | 4/2010 | Joys et al. | |
| 2010/0175576 | A1* | 7/2010 | Weeks et al. | 102/509 |
| 2011/0017050 | A1 | 1/2011 | Robinson et al. | |
| 2014/0013990 | A1* | 1/2014 | LeaSure | F42B 12/34 102/517 |

OTHER PUBLICATIONS

International Preliminary Report on Patentability for PCT/US2013/052509 Date: Jan. 27, 2015 pp. 6.

* cited by examiner

FRANGIBLE PROJECTILE

CROSS-REFERENCE TO RELATED APPLICATION

This application claims the benefit and priority of U.S. Provisional Application No. 61/676,434 filed Jul. 27, 2012. The entire disclosures of the above applications are incorporated herein by reference.

FIELD

The present invention relates to frangible projectiles.

BACKGROUND OF THE INVENTION

This section provides background information related to the present disclosure which is not necessarily prior art.

A frangible projectile is a projectile that disintegrates upon impacting a target to minimize its travel. Frangible projectiles are most commonly used in shooting ranges, because they are less likely to pass through the intended target or ricochet. However, frangible projectiles are also used in other, non-training applications, for example in situations where there is heightened concern about damage to property or injury to persons adjacent the intended target. For example, some frangible projectiles will disintegrate upon striking wallboard, making it less likely that a shot will damage property or injure persons in adjacent rooms.

Frangible projectiles preferably can be fired from conventional weapons, and thus preferably have physical and ballistic properties comparable to conventional projectiles.

There are competing considerations in designing a frangible projectile that is of reasonable cost, that can be reliably fired, and yet which breaks up as intended upon striking its intended target. Many attempts have been made to provide such projectiles, including U.S. Pat. No. 7,685,942 on Frangible Powdered Iron Projectiles; U.S. Pat. No. 7,555,987 on Frangible Powered Iron Projectiles; U.S. Pat. No. 7,380,503 Method And Apparatus For Self-Destruct Frangible Projectiles; U.S. Pat. Nos. 7,322,297 and 7,143,679 Cannelured Frangible Projectile And Method Of Canneluring A Frangible Projectile; U.S. Pat. No. 6,892,647 Lead Free Powdered Metal Projectiles; U.S. Pat. No. 6,799,518 Method And Apparatus For Frangible Projectiles; U.S. Pat. No. 6,694,888 Frangible Bullet; U.S. Pat. No. 6,691,623 Frangible Powdered Iron Projectiles; U.S. Pat. No. 6,536,352 Lead-free Frangible Bullets And Process For Making Same; U.S. Pat. No. 6,263,798 Frangible Metal Bullets, Ammunition And Method Of Making Such Articles; U.S. Pat. No. 6,257,149 Lead-free Bullet; U.S. Pat. No. 6,240,850 Bullets For Use In Hitting Targets At Short Range; U.S. Pat. No. 6,115,894 Process Of Making Obstacle Piercing Frangible Bullet; U.S. Pat. No. 6,090,178 Frangible Metal Bullets, Ammunition And Method Of Making Such Articles; U.S. Pat. No. 6,074,454 Lead-free Frangible Bullets And Process For Making Same; U.S. Pat. No. 5,917,143 Frangible Powdered Iron Projectiles; U.S. Pat. No. 5,894,645 Method Of Forming A Non-Toxic Frangible Bullet Core; U.S. Pat. No. 5,852,858 Non-toxic Frangible Bullet; U.S. Pat. No. 5,852,255 Non-toxic Frangible Bullet Core; U.S. Pat. No. 5,763,819 Obstacle Piercing Frangible Bullet; U.S. Pat. No. 5,679,920 Non-toxic Frangible Bullet; U.S. Pat. No. 5,665,808 Low Toxicity Composite Bullet And Material Therefore; and U.S. Pat. No. 5,616,642 Lead-free Frangible Ammunition, the disclosures of which is incorporated herein by reference.

SUMMARY OF THE INVENTION

This section provides a general summary of the disclosure, and is not a comprehensive disclosure of its full scope or all of its features.

Generally, embodiments of this invention provide a frangible projectile comprising a pressed or sintered mass of a plurality of copper or copper alloy plated core particles of iron or an iron alloy.

The coated particles comprising the pressed or sintered mass preferably are between about 12 μm and about 336 μm, and more preferably between about 32 μm and about 181 μm. The iron or iron alloy cores are between about 10 μm about 330 μm, and more preferably between about 30 μm and about 175 μm. Particles smaller than about 10 μm are difficult to plate and particles over about 200 μm have undesirable flow characteristics that can interfere plating as well as in charging the plated powder for pressing. A particle population can be prepared from commercially available iron powders by trimming the natural distribution using sieving and de-dusting methods.

The copper or copper alloy plating can be applied by any suitable method, such as chemical or electrochemical plating. The plating can be of essentially pure copper, formed by depositing copper on the iron cores, or the plating can be a copper alloy formed by depositing copper and one or more other metals on the iron cores. The plating is sufficiently thick to allow the particles to bond together sufficiently to achieve the desired mechanical properties, and is preferably up to about 3 μm.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

DETAILED DESCRIPTION

Figure 1:
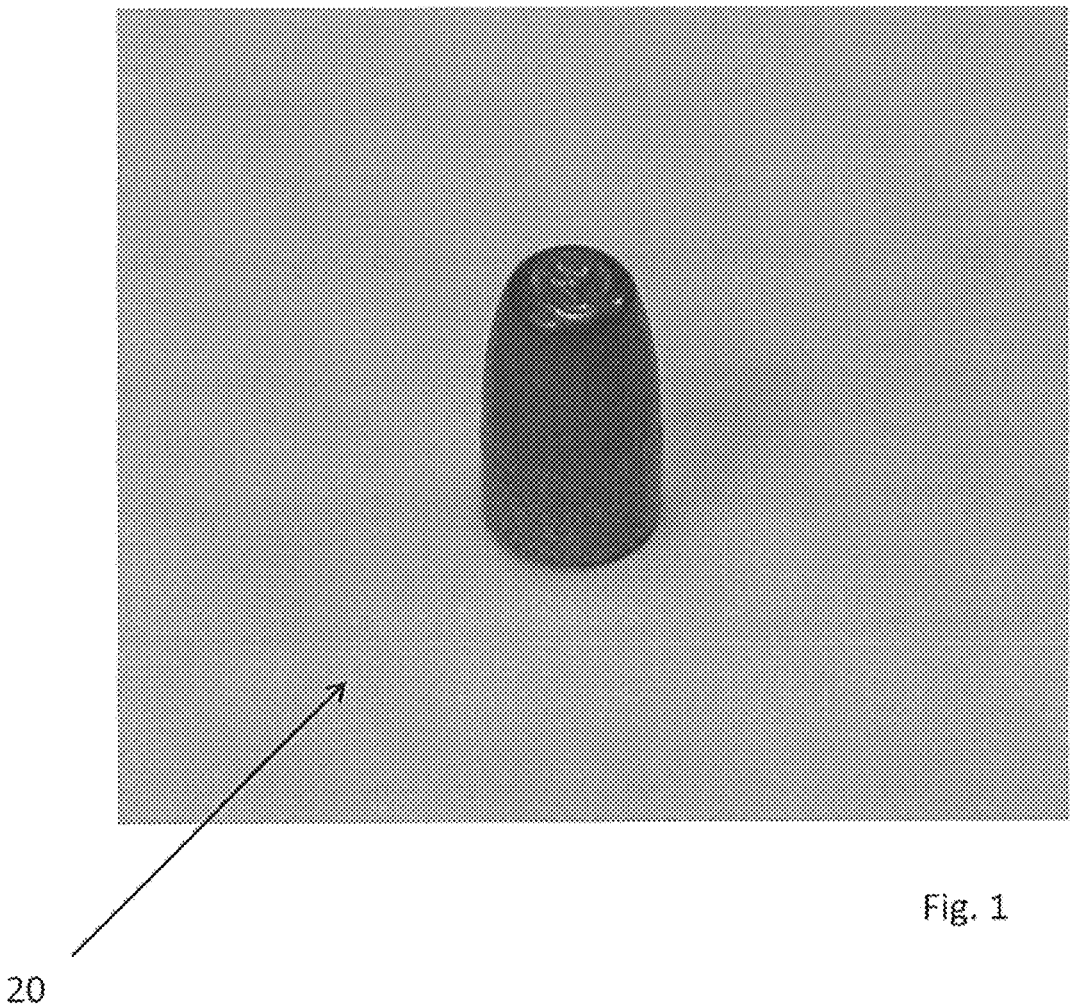
FIG. 1 is a photograph of a frangible projectile of the type made from compacted metal powder, such as might be made from the copper plated iron powder disclosed herein.

A frangible projectile constructed according to the principles of this invention is indicated generally as 20 in FIG. 1. The projectile 20 is a conventional pistol bullet, but the invention is not so limited and the frangible projectile can be a rifle bullet or any other type of projectile.

The projectile comprises a plurality of particles that are pressed or sintered (heated and pressed) together to form a frangible solid. At least some, and preferably the majority of the particles are an iron or iron alloy core with a copper or copper alloy plating. These particles are preferably generally spherical, i.e., they generally have an aspect ratio (ratio of longest dimension to shortest dimension) near 1. The particles are preferably between about 12 μm and about 336 μm, and more preferably between about 32 μm and about 181 mm in diameter. The particles do not have to be of uniform shape or size, and preferably a population having a variety of particle shapes sizes.

Figure 2:
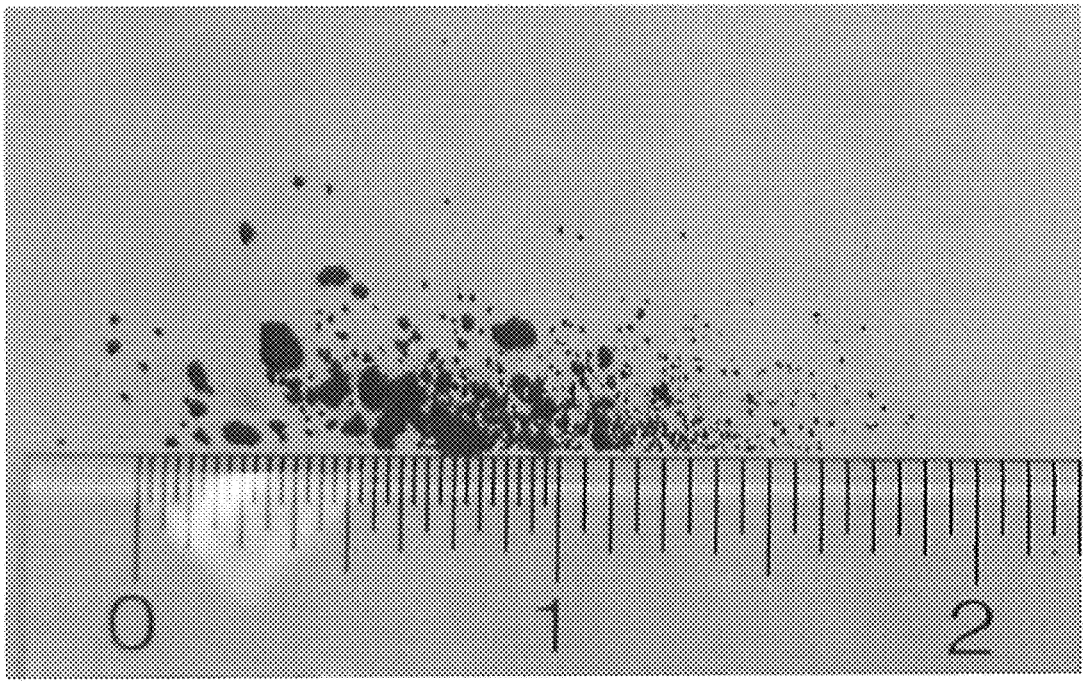
FIG. 2 is a photograph of an example iron powder that can be used in various embodiments of the invention.

The particles are preferably formed from iron or iron alloy cores. These cores are preferably generally spherical, i.e., they generally have an aspect ratio (ratio of longest dimension to shortest dimension) near 1, although they are generally irregularly shaped. The cores are preferably about 10 μm about 330 μm, and more preferably between about 30 μm and about 175 μm in diameter. The cores do not have to be of uniform size. The content can range from pure iron (with unavoidable purities) to iron alloys. Iron and Iron alloys provide relatively high density at relative low cost. The particular properties are not particularly important. FIG. 2 is a photograph, showing an iron powder that can be used in embodiments of the invention.

The iron or iron alloy cores are plated with a copper or copper alloy. It is believed to be simplest and least expensive to plate the cores with pure copper with an electroplating or chemical deposition process. However, it is also possible to plate the cores with a copper alloy by co-depositing copper and one or more other metals with an electroplating or chemical deposition process, or to sequentially deposit copper and other metals, and allow an alloy to form by heating the plated particles. It is even possible that the formation of the alloy occurs during the sintering process. However, the pure or substantially pure copper plating that results from conventional chemical deposition or electroplating processes is believed by the inventors, to be adequate in most cases.

The plating is preferably between about 1.9 μm and about 4 μm, and preferably averages less than about 3 μm.

The particles can then be formed into the final projectile shape by pressing and/or heating to cause the copper or copper alloy plating to bind the particles together. Additional binders, such as polymeric materials can be added to facilitate the formation of the projectiles. The projectile can then be subject to any finishing steps, including for example plating a jacket on the projectile 20. Such a jacket is not necessary, but it enhances the appearance of the frangible projectile, and may help stabilize the projectile as it is assembled into ammunition, transported, stored, loaded, and even fired.

The final physical properties of the mass can be controlled at least in part by controlling the heating and pressure applied. Binding agents, filler, and other types of particles can be included to further control the properties as desired.

In the past frangible bullets containing iron particles were sometime disfavored because the iron particles could cause sparking, particularly when striking iron or steel objects. Depending upon where the bullets are used, this sparking can present a risk, and has even been known to start fires when not used properly. Because most, if not all, of the iron particles are coated, this tendency is reduced. The ability to use iron allows the cost of the frangible projectiles to be kept low, while maintaining the weight of the projectile closer to the weight of conventional projectiles. Furthermore, the need for lead or other heavy metals is reduced or eliminated.

What is claimed is:

1. A frangible projectile comprising a sintered mass of a plurality of particles, the particles having a core of iron or an iron alloy between about 30 μm and about 175 μm diameter, and a plating of copper or copper alloy between about 1 μm and about 4 μm thick.

2. The frangible projectile according to claim 1, wherein the average thickness of the copper or copper alloy plating is about 3 μm thick.

3. A frangible projectile comprising a sintered mass of a plurality of particles, the particles having a core of iron or an iron alloy, and a plating of copper or copper alloy between about 1 μm and about 4 μm thick.

4. The frangible projectile according to claim 3, wherein the average thickness of the copper or copper alloy plating is about 3 μm thick.

5. The frangible projectile according to claim 3, wherein the iron core particles are generally spherically shaped.

6. A round of ammunition comprising a shell casing containing a propellant and a primer, and having a frangible projectile according to claim 3 disposed in a shell casing.

7. The frangible projectile according to claim 3, wherein the sintered mass further includes at least one of copper particles, copper alloy particles, iron particles and iron alloy particles.

8. The frangible projectile according to claim 3, wherein the projectile comprises at least 50% by the mass of the copper or copper alloy plated iron or iron alloy core particles.

9. The frangible projectile according to claim 8, wherein the sintered mass further includes at least one of copper particles, copper alloy particles, iron particles and iron alloy particles.

10. The frangible projectile according to claim 3, wherein the iron or iron alloy core particles are between about 10 μm and about 330 μm diameter.

11. The frangible projectile according to claim 10, wherein the iron or iron alloy core particles are between about 30 μm and about 175 μm diameter.

* * * * *